US005927403A

United States Patent [19]

Dallas

[11] Patent Number: 5,927,403

[45] Date of Patent: Jul. 27, 1999

[54] APPARATUS FOR INCREASING THE FLOW OF PRODUCTION STIMULATION FLUIDS THROUGH A WELLHEAD

[76] Inventor: L. Murray Dallas, 801 New England Ct., Allen, Tex. 75002

[21] Appl. No.: 08/837,574

[22] Filed: Apr. 21, 1997

[51] Int. Cl.[6] ..... E21B 33/068

[52] U.S. Cl. ..... 166/77.51; 166/84.5; 166/85.3; 166/90.1

[58] Field of Search ..... 166/368, 382, 166/387, 77.51, 85.3, 84.5, 90.1

[56] References Cited

U.S. PATENT DOCUMENTS

| | | | |
|---|---|---|---|
| 3,561,531 | 2/1971 | Miller . | |
| 3,738,426 | 6/1973 | Drouin . | |
| 3,739,846 | 6/1973 | Beson | 166/89.2 |
| 4,076,079 | 2/1978 | Hericks et al. . | |
| 4,512,410 | 4/1985 | Forester . | |
| 4,513,816 | 4/1985 | Hubert . | |
| 4,703,807 | 11/1987 | Weston . | |
| 4,832,128 | 5/1989 | Light et al. . | |
| 4,993,488 | 2/1991 | McLeod . | |
| 5,012,865 | 5/1991 | McLeod . | |
| 5,114,158 | 5/1992 | Le . | |
| 5,205,356 | 4/1993 | Bridges et al. . | |
| 5,394,943 | 3/1995 | Harrington . | |
| 5,540,282 | 7/1996 | Dallas . | |
| 5,544,707 | 8/1996 | Hopper et al. | 166/382 |
| 5,605,194 | 2/1997 | Smith | 166/382 |
| 5,615,739 | 4/1997 | Dallas . | |
| 5,819,851 | 10/1998 | Dallas | 166/86.1 X |

FOREIGN PATENT DOCUMENTS 1302235 6/1992 Canada .

*Primary Examiner*—Roger Schoeppel
*Attorney, Agent, or Firm*—Dority & Manning, P.A.

[57] ABSTRACT

An apparatus for increasing the transfer rate of production stimulation fluids through a wellhead of a hydrocarbon well is disclosed. The apparatus includes a mandrel for a wellhead isolation tool and a tubing hanger for use in conjunction with the mandrel. The mandrel includes a bottom end to which an annular seal is bonded. The annular seal cooperates with a sealing surface in a top end of the tubing hanger to isolate the wellhead equipment from the high pressures and corrosive and/or abrasive materials pumped into the well during a production stimulation treatment. The novel construction for the mandrel and the tubing hanger eliminates the requirement for a packoff assembly attached to a bottom of the mandrel and thereby permits the mandrel to have a larger internal diameter for increasing the transfer rate of production stimulation fluids through the wellhead. The advantages include a mandrel which accommodates faster transfer rates, is less prone to catch on constrictions as the mandrel is stroked through the wellhead and requires no packoff assembly for sealing within the production tubing. A further advantage is the provision of a mandrel for a wellhead isolation tool that eliminates all joints between the high pressure tubing connector and the production tubing to minimize washout during production stimulation using abrasive proppants.

25 Claims, 3 Drawing Sheets

APPARATUS FOR INCREASING THE FLOW OF PRODUCTION STIMULATION FLUIDS THROUGH A WELLHEAD

TECHNICAL FIELD

The present invention relates to the stimulation of the production zones of hydrocarbon wells using high pressure production stimulation fluids and, in particular, an apparatus for increasing the rate at which stimulation fluids can be pumped through a wellhead protected by a wellhead isolation tool.

BACKGROUND OF THE INVENTION

It is common practice to stimulate the production of hydrocarbon wells using fluids that are pumped at high pressures and flow rates into the production zones of the well. The stimulation fluids pumped into the production zones may be highly acidic, and may also be laden with abrasive proppants such as bauxite or silica sand. Consequently, such fluids are frequently corrosive and/or abrasive and can cause irreparable damage to wellhead equipment if they are pumped directly through the spools and valves that make up the wellhead. To prevent such damage, wellhead isolation tools have been invented and various configurations are known. Examples of such tools are taught in at least the following patents and patent applications:

U.S. Pat. No. 3,830,304—Cummins

U.S. Pat. No. 4,241,786—Bullen

U.S. Pat. No. 4,632,183—McLeod

U.S. Pat. No. 4,111,261—Oliver

U.S. Pat. No. 4,867,243—Garner et al.

U.S. Pat. No. 5,372,202—Dallas

U.S. Pat. No. 5,332,044—Dallas

Canadian Patent 1,292,675—McLeod

Canadian Patent 1,277,230—McLeod

Canadian Patent 1,281,280—McLeod

Canadian Patent Application 2,055,656—McLeod

All of the wellhead isolation tools described in the patents and applications listed above operate on the same general principle. Each includes a mandrel which is stroked through the various valves and spools of the wellhead to isolate those components from the elevated pressures and corrosive and/or abrasive fluids used in the production stimulation process. A top end of the mandrel is connected to one or more high pressure valves through which the stimulation fluids are pumped. A bottom end of the mandrel is provided with a packoff assembly for achieving a fluid seal with the production tubing in the well. The mandrel is stroked down through the wellhead to an extent that it enters a top of the production tubing string where the packoff assembly seals against the inside of the production tubing so that the wellhead is completely isolated from the stimulation fluids.

The internal passage through a standard wellhead valve is about 2.56" (6.5 cm). The internal diameter of a standard production tubing is about 2.441" (6.2 cm). A mandrel for a wellhead isolation tool must be constructed to withstand at least about 10,000 psi. Consequently, the maximum internal diameter for a mandrel of any one of the wellhead isolation tools described in the patents listed above is about 1.5" (3.8 cm) when designed for use with a wellhead and production tubing of standard dimensions. If stimulation fluids are pumped through a mandrel of that size at 200 feet per second, the fluid transfer rate is about 26 barrels per minute (BPM). Higher transfer rates for abrasive fluids are undesirable because they cause too much "washout," a phenomenon in which the mandrel and/or the production tubing is damaged by abrasive fluids which erode away the walls of those components and may erode completely through one or the other, which permits high pressure fluids to escape into the wellhead and/or the well casing. The maximum fluid transfer rate through a wellhead isolation tool having a packoff assembly is therefore about 26 BPM.

Wellhead isolation tools having a packoff assembly that seals with an inside of the production tubing also suffer from other drawbacks. First, because the packoff assembly is attached to the bottom end of the mandrel, it is the packoff assembly that leads the way through the valves and spools of the wellhead. The packoff assembly is, however, larger than the mandrel and has a leading edge of rubberized sealing material that seals against the inside of the production tubing. Because of its size, the packoff assembly has a tendency to catch on constrictions as it is stroked through the wellhead, especially if the mandrel is not perfectly straight. It is not uncommon, for example, for the packoff assembly to catch on the back pressure threads of the tubing hanger. When the packoff assembly catches on a constriction in the wellhead, the sealing material at the leading edge may be torn. The mandrel itself may also be bent or buckled because it is being hydraulically forced through the wellhead by an operator who cannot see its progress, and its relatively small diameter causes it to be weak. Second, all prior art mandrels include at least one joint, namely the joint between the mandrel and the packoff assembly. Joints are undesirable because they can create eddies in the production stimulation fluids which cause washout in the area of the joint. If joints in a mandrel can be eliminated, the incidence of washout is reduced.

When a well is stimulated to increase the production of hydrocarbons, the well stimulation equipment is generally rented from well service providers who furnish the equipment with a crew on an hourly basis. Since the stimulation of any given production zone requires a certain volume of fluids, it is desirable to pump the stimulation fluids at the highest possible rate in order to minimize expense. To date, the transfer rate has been limited by the internal diameter of the wellhead isolation tool mandrel. Although the internal diameter of the passage through the wellhead is a limiting factor on the size of a mandrel, it is desirable to increase the internal diameter of the mandrel within those limits to a maximum possible extent.

SUMMARY OF THE INVENTION

It is therefore an object of the invention to provide a mandrel for a wellhead isolation tool that has a larger internal diameter for providing a higher fluid transfer rate of production stimulation fluids through the wellhead.

It is another object of the invention to provide a mandrel for a wellhead isolation tool that has a leading end which is not prone to catching on constrictions as the mandrel is stroked through the wellhead.

It is yet another object of the invention to provide a mandrel for a wellhead isolation tool that eliminates all joints between the high pressure valve and the production tubing to minimize washout during production stimulation using abrasive proppants.

It is yet a further object of the invention to provide a novel construction for a tubing hanger which provides a sealing surface against which a mandrel in accordance with the invention may seat in a fluid tight seal, thus eliminating the requirement for a packoff assembly that seals within the production tubing.

These objects of the invention are realized in a novel construction for a mandrel for a wellhead isolation tool and a tubing hanger for use in conjunction with the mandrel.

The mandrel comprises a hollow high pressure tubing having a top end, a bottom end, an outer sidewall and a fluid passage that extends between the top end and the bottom end, and an annular seal that is bonded above the bottom end to the outer wall of the tubing.

The mandrel cooperates with a tubing hanger for suspending production tubing in the well. The tubing hanger comprises a body having a top end, a bottom end, an outer wall and a fluid passage that extends from the top end to the bottom end for fluid communication through the body, the bottom end being adapted for the attachment of the tubing string to the body so that the tubing string is in fluid communication with the fluid passage through the body, a top end of the fluid passage including a sealing surface for fluid tight engagement with the annular seal bonded to the outer circumference of the mandrel when it is inserted into the fluid passage, and the body being adapted to be received and sealingly supported in a tubing spool mounted to a head of the hydrocarbon well.

The invention therefore provides a novel combination of apparatus for "packing off" a wellhead isolation tool to provide significantly more fluid transfer capacity through a wellhead that is isolated for a production stimulation treatment. By replacing the prior art packoff assembly with an annular seal bonded directly to an outer wall of the wellhead isolation tool mandrel, the outer diameter of the mandrel can be significantly increased and the diameter of the fluid passage through the mandrel can be correspondingly enlarged.

There is no sealing surface provided in the fluid passage of most prior art tubing hangers. Although, some tubing hangers do provide a sealing surface to which an annular seal on a mandrel in accordance with the invention can be adapted to packoff, a new tubing hanger has been invented to provide a sealing surface expressly designed to cooperate with the annular seal on the novel mandrel.

Using a mandrel and a tubing hanger in accordance with the invention, the fluid transfer rate for fluids pumped at 200 feet per second increases from about 26 BPM achieved with the prior art mandrels to about 40 BPM at the same pump rate, an increase of 54 percent over the transfer rate of prior art wellhead isolation tools.

The annular seal bonded to the mandrel is preferably made from a synthetic rubber or a plastic resin. Preferred examples are a neoprene rubber or a polypropylene resin.

The tubing hanger may have any convenient configuration so long as it provides a sealing surface at a top of the fluid passage for fluid tight sealing engagement with the annular seal on the mandrel of the isolation tool.

Although the annular seal may be positioned in close proximity to the bottom end of the mandrel, it is preferably located far enough above the bottom end of the mandrel that the mandrel extends down through the tubing hanger at least past the back pressure threads when the annular seal is packed off against the sealing surface, and more preferably, the bottom end of the mandrel extends into a top of the tubing string when the mandrel is packed off with the tubing hanger.

BRIEF DESCRIPTION OF THE DRAWINGS

The invention will now be further explained by way of example only and with reference to the following drawings, wherein.

DETAILED DESCRIPTION OF THE PREFERRED EMBODIMENT

Figure 1:
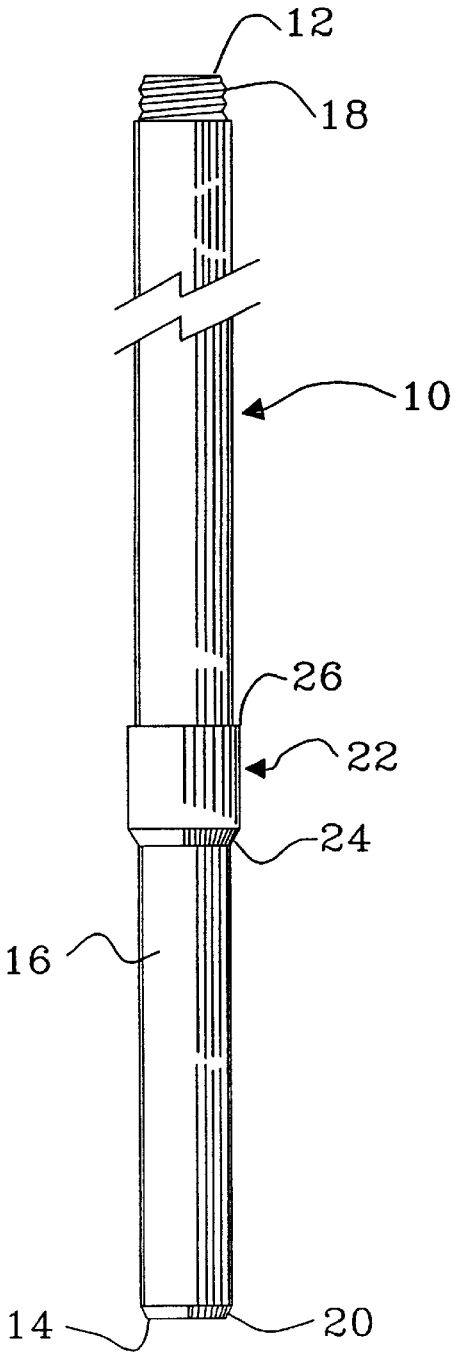
FIG. 1 is an elevational view of a mandrel in accordance with the invention for a wellhead isolation tool.

FIG. 1 shows an elevational view of a mandrel 10 in accordance with the invention. The mandrel 10 may be adapted for use with any known configuration of a wellhead isolation tool. The mandrel 10 is a length of high pressure tubing well known in the art, having a top end 12, a bottom end 14 and an outer sidewall 16 with a fluid passage that extends between the top end 12 and the bottom end 14. The top end 12 includes a threaded connector 18 for connection with a high pressure valve (see FIG. 4), or the like, in a manner well known in the art. The use of the threaded connector 18 at the top end 12 of the mandrel 10 will depend on the wellhead isolation tool with which the mandrel is used. The threaded connector 18 may be connected to a mandrel joint, a high pressure valve, a high pressure tubing connector, or the like.

As is apparent, the bottom end 14 of the mandrel 10 does not include a packoff assembly. The bottom end 14 preferably has a bevelled edge 20 to guide the mandrel 10 through the vertical passage in a wellhead that typically includes several valves and spools, all well known in the art. The mandrel 10 includes an annular seal 22 for fluid tight engagement (hereinafter referred to as a "packoff") with a fluid passage in a tubing hanger shown in FIG. 2. The annular seal 22 is preferably bonded above the bottom end of the outer wall of the mandrel for reasons which will be explained below with reference to FIG. 3. The annular seal 22 is preferably constructed using a resilient sealing material such as a neoprene rubber or a plastic polymer resin such as a polypropylene. The annular seal 22 is bonded directly to the side wall 16 of the mandrel 10 using methods well known in the art. Regardless of whether the annular seal 22 is made from a rubber compound or a plastic polymer, it preferably has a durometer of at least about 70. The annular seal 22 has a bottom shoulder 24 which is preferably bevelled at about 30 degrees to facilitate entry of the seal into the tubing hanger as will be explained below with reference to FIG. 3. As will also be explained in more detail with reference to FIG. 3, the sidewall 16 of the mandrel 10 preferably has a smaller diameter commencing at a top shoulder 26 of the annular seal 22. The reduced diameter at the lower end of the mandrel has two beneficial effects. First, it gives an abutment for the top shoulder 26 of the annular seal 22 to reinforce the bond between the annular seal 22 and the sidewall 16 of the mandrel 10. Second, it reduces the outer diameter of the mandrel 10 to facilitate entry of the mandrel through the back pressure threads of the tubing hanger as will also be explained below with reference to FIG. 3.

Figure 2:
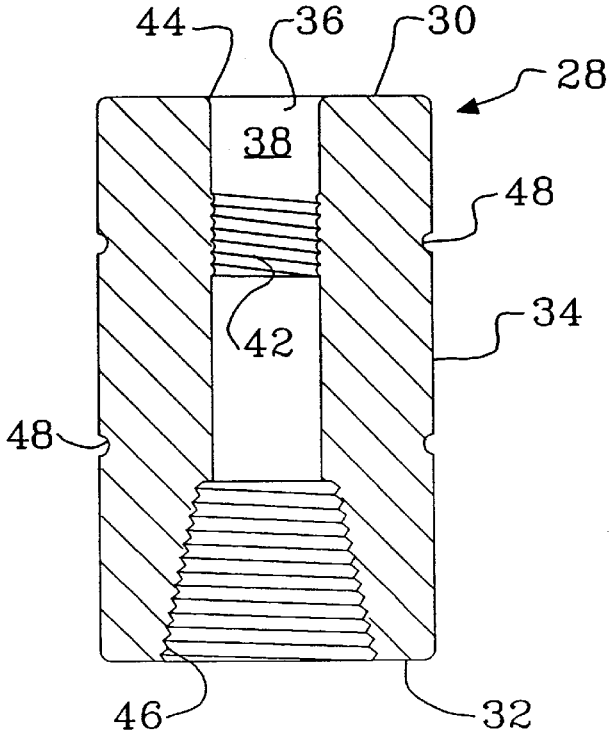
FIG. 2 is a cross-sectional view of one configuration for a tubing hanger in accordance with the invention.

FIG. 2 shows a cross-sectional view of a preferred configuration for a tubing hanger 28 in accordance with the invention. The tubing hanger 28 is a body made of steel which includes a top end 30, a bottom end 32, an outer wall 34 and a fluid passage 36 that extends from the top end 30 to the bottom end 32 for fluid communication through the tubing hanger. The tubing hanger 28 is adapted to be received and supported in a tubing spool (see FIG. 4) mounted to a head of a hydrocarbon well. The tubing hanger 28 supports a production tubing string in a manner well known in the art. The shape and configuration of tubing hanger 28 will depend upon the shape and configuration of the tubing spool in which the tubing hanger 28 is received and supported. The shape and configuration of the tubing hanger 28 is immaterial so long as the fluid passage 36 in the top end 30 (commonly referred to as the "upper donut") is of a shape and size to provide a sealing surface 38 for the annular seal 22 on the mandrel 10. The sealing surface 38 is located above a back pressure thread 42 in the fluid passage 36. The back pressure threads 42 permit the installation of a back pressure valve to a top of the tubing hanger so that a blowout protecter can be safely removed from wellhead. The back pressure threads 42 are a common feature of tubing hangers and are well known in the art. The sealing surface 38 is preferably a smooth cylindrical surface having a rounded top shoulder 44 to facilitate entry of the annular seal 22 into the fluid passage 36. The sealing surface 38 is preferably at least about 1.5" (3.8 cm) long and preferably has a diameter which is about 0.050" (1.27 mm) smaller than the outer diameter of the annular seal 22. In the preferred embodiment of the mandrel 10 and the tubing hanger 28, the sealing surface 38 has a diameter of about 2.40" (6.10 cm) and the annular seal 22 has a length of about 2" (5.08 cm) and an outer diameter of about 2.450" (6.22 cm). The bottom end of the fluid passage 36 includes a threaded connector 46, typically a 2⅞" EUE thread for the connection of a production tubing typically having an internal diameter of 2.441" (6.2 cm). The outer wall 34 of the tubing hanger 28 preferably includes at least two annular grooves 48 which accommodate high pressure O-rings to provide a fluid tight seal between the outer wall 34 of the tubing hanger 28 and a sealing surface in a tubing spool which receives and supports the tubing hanger 28 in a manner well known in the art.

Figure 3:
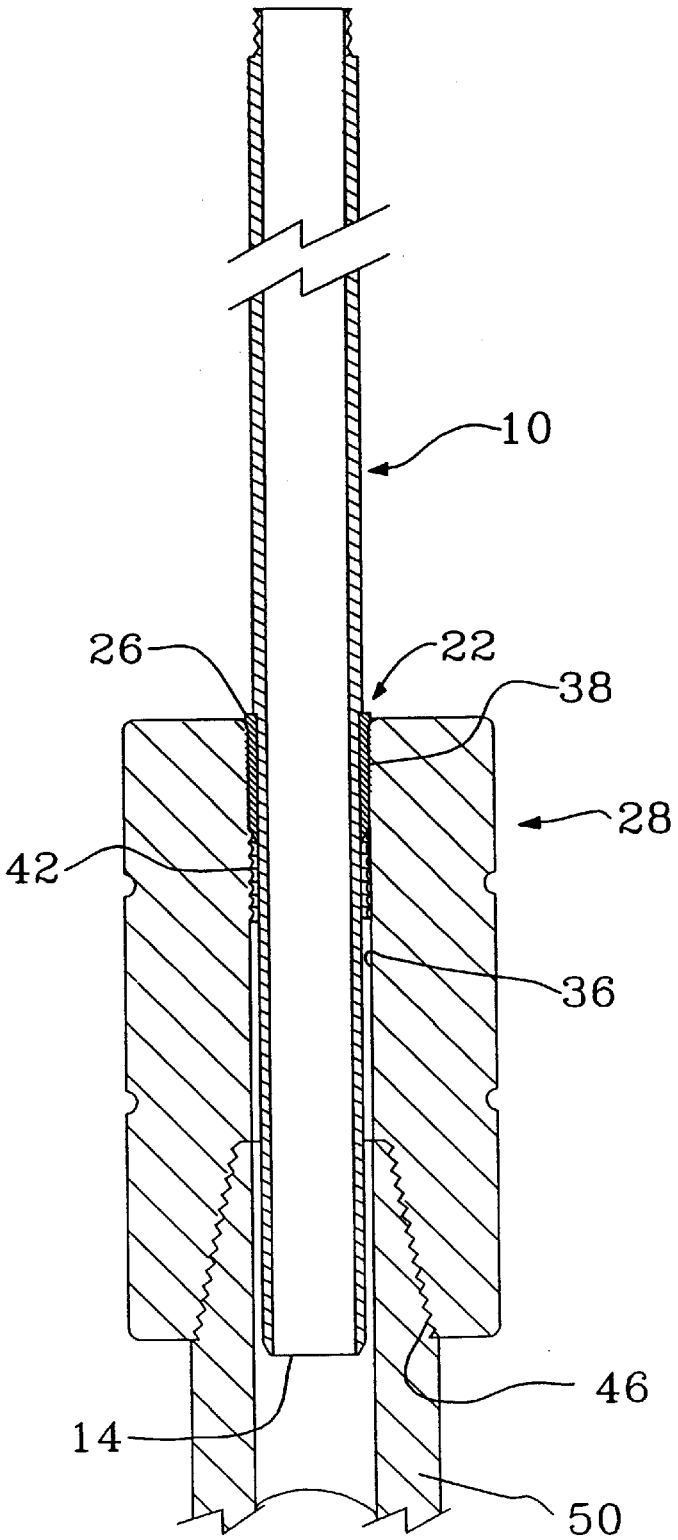
FIG. 3 is a cross-sectional view of the mandrel shown in FIG. 1 packed off in the tubing hanger shown in FIG. 2 with a production tubing connected to the tubing hanger.

FIG. 3 shows a cross-sectional view of the mandrel 10 stroked through the tubing hanger 28 so that the annular seal 22 is packed off against the sealing surface 38 of the tubing hanger 28 in a fluid tight seal. A production tubing 50 is connected to the threaded connector 46 at the bottom end of the fluid passage 36. As shown in FIG. 3 it is preferable that the bottom end 14 of the mandrel 10 extend through the fluid passage 36 at least past the back pressure threads 42 and preferably past the joint between the tubing hanger 28 and the top of the production tubing 50 in order to minimize the possibility of damaging the back pressure threads 42 or washing out the joint between the production tubing 50 and the tubing hanger 28. In order to ensure that the mandrel extends into the top of the production tubing 50, the top shoulder 26 of the annular seal 22 is preferably located about 12" (30.5 cm) above the bottom end 14 of the mandrel 10. As mentioned above and is readily apparent from FIG. 3, the lower end of the mandrel 10 is preferably reduced in diameter. In a preferred embodiment of the mandrel 10, the mandrel is made of a high pressure tubing having an outer diameter of 2.375" (6.03 cm). The lower end of the mandrel 10, commencing at the top shoulder 26 of the annular seal 22 is preferably machined down to about 2.20" (5.59 cm). This area of reduced diameter preferably has a length of about 12" (30.48 cm) so that the lower end 14 of the mandrel 10 extends about 10" (25.4 cm) beyond the bottom shoulder 24 of the annular seal 22. This area of reduced diameter provides more clearance for stroking the mandrel 10 past the back pressure threads 42. It also facilitates passage through the constrictions in the wellhead because the leading end of the mandrel 10 is smaller in diameter than the annular seal 22. The annular seal 22 therefore tends to centralize the bottom end 14 of the mandrel 10 as the annular seal 22 passes through a constriction in the wellhead such as a gate valve.

Figure 4:
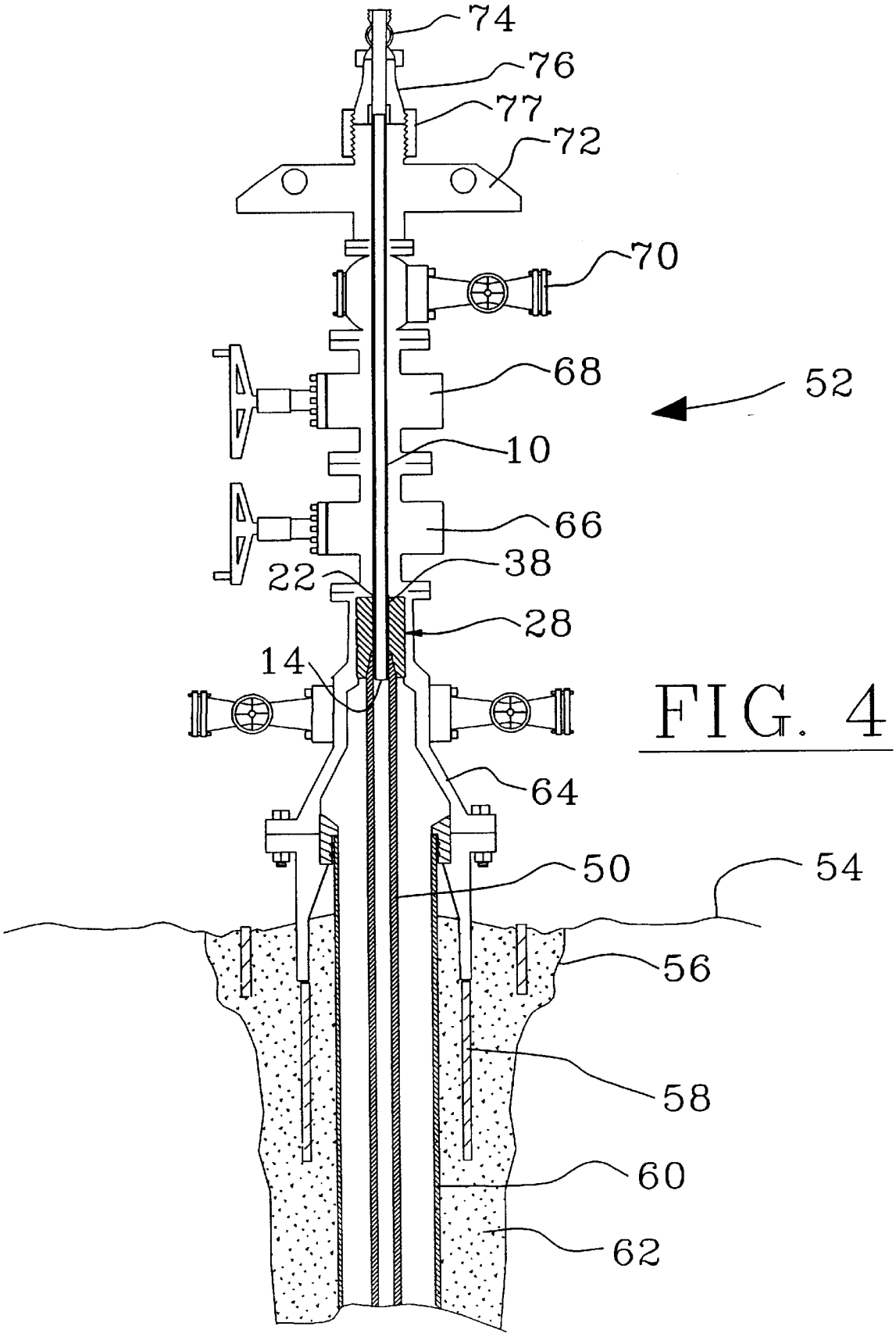
FIG. 4 is a schematic view of the tubing hanger installed in a tubing spool of a wellhead with the mandrel stroked through the wellhead and seated in a fluid tight sealing engagement with a sealing surface of the tubing hanger.

FIG. 4 shows the tubing hanger 28 installed in a typical wellhead generally indicated by reference 52. The ground surface is indicated by reference 54. The well itself, only an upper portion of which is illustrated, includes a well bore 56 lined with an outer or surface casing 58 and a production casing 60. The space between the walls of the well bore and/or production casing is filled with specific kinds of oil well cement 62. Located inside the production casing 60 is the production tubing 50 through which hydrocarbons may be brought to the surface. The production tubing 50 is supported in the well by the tubing hanger 28.

The wellhead is constructed in a well known manner from a series of valves and related flanges. The wellhead schematically illustrated in FIG. 4 includes a tubing spool 64 which receives and supports the tubing hanger 28. Connected by flange connections to the top of the tubing spool 64, are a pair of valves 66 and 68, by way of example. A third valve 70 is connected to the valve 68. The purpose of the three valves 66, 68 and 70 is to control the flow of hydrocarbons from the well.

Mounted to a top of the valve 70 is a wellhead isolation tool described in U.S. Pat. No. 4,867,243, by way of example, which is herein incorporated by reference. The wellhead isolation tool is equipped with a mandrel in accordance with the invention. The mandrel 10 has been stroked down through the wellhead 52 and the wellhead isolation apparatus has been removed from a top of the wellhead so that only a base plate member 72, a high pressure valve 74 and a high pressure tubing connector 76 remain on the wellhead. The wellhead is therefore prepared for the connection of a high pressure line (not illustrated) to the high pressure valve 74 so that production stimulation fluids can be pumped into the well through the mandrel 10 and the production tubing 50. As will be understood by those skilled in the art, the mandrel 10 can be used with any known wellhead isolation tool, not just the one illustrated here for the purpose of example. It will also be understood by those skilled in the art that the tubing hanger 28 can be adapted for use in any tubing spool. It will be further understood that, as described above, some prior art tubing hangers provide a sealing surface to which the annular seal 22 on the mandrel 10 can be adapted to packoff. In that case, the size and shape of the annular seal 22 may be somewhat different from the size and shape of the annular seal 22 described above, but the principles of construction and use remain the same.

As can be seen in FIG. 4, the mandrel 10 extends from the high pressure tube connector 26 into a top of the production tubing 50 without a joint. As has been explained above, their is no packoff assembly on the bottom end 14 of the mandrel 10. The fluid seal between the production tubing 50 and the mandrel 10 is effected by the annular seal 22 which sealingly engages the sealing surface 38 in the upper donut of the tubing hanger 28. Experimentation has shown that the annular seal 22 can withstand at least 10,000 psi of fluid pressure. Consequently, the valves and flanges of the wellhead are completely isolated from the production stimulation fluids and the extreme fluid pressures common during production stimulation treatments. Since the mandrel 10 extends from the high pressure tube connector 76 into the top end of the production tubing 50, there are no joints in the mandrel 10 which reduces washout and promotes safer operation. Furthermore, since the mandrel 10 includes no packoff assembly on its lower end 14 the internal diameter of the mandrel 10 is larger than prior art mandrel and permits fluid transfer rates that are up to 54 percent greater than fluid transfer rates achievable with prior art mandrels.

Because the annular seal 22 must sealingly engage the sealing surface 38 of the tubing hanger 28, it is important that the length of the mandrel be adapted to the particular wellhead being isolated for a production stimulation treatment. This is readily accomplished using measurement methods well known in the art to determine the length of the mandrel required for a particular wellhead, and stocking a plurality of mandrels 10 which are individually adapted to a particular wellhead configuration. It will also be understood by those skilled in the art, that the length of the mandrel may be adjusted to include one or more extension sections in order to adapt the mandrel to a desired length as opposed to providing a separate mandrel for each wellhead configuration. It is also desirable to adapt the wellhead isolation tool being used with the mandrel 10 to provide extra length of adjustment in the lockdown nut assembly (or equivalent). For example, as shown in FIG. 4, the lockdown nut 77 which locks down the mandrel 10 during well stimulations is elongated to provide extra length of adjustment since the annular seal 22 must be seated against the sealing surface 38 of the tubing hanger 28.

As noted above, the mandrel 10 and the tubing hanger 28 provide a novel structure for the isolation of a wellhead to permit production stimulation at extreme pressures using corrosive and/or abrasive fluids which may be transferred through the wellhead at significantly higher rates than where previously possible. The time required for production stimulation treatments is therefore considerably reduced and costs are correspondingly controlled.

Changes and modifications of the preferred embodiments of the invention described above may be apparent to those skilled in the art. For example, as noted above, the annular seal 22 of the mandrel 10 may be adapted to packoff with a sealing surface in the fluid passage of a prior art tubing hanger. As a further example, the area of reduced diameter at the bottom end of the mandrel 10 may be only as long as the annular seal 22, or the mandrel 10 may be the same diameter from the top end 12 to the bottom end 14. The scope of the invention is therefore intended to be limited solely by the scope of the appended claims.

I claim:

1. A mandrel for a wellhead isolation tool, comprising:

a high pressure tubing having a top end, a bottom end, an outer sidewall and a fluid passage that extends between the top end and the bottom end; and an annular seal for fluid tight engagement with a sealing surface in a fluid passage in a tubing hanger, the annular seal being bonded to the outer sidewall above the bottom end of the high pressure tubing.

2. The mandrel for a wellhead isolation tool as claimed in claim 1 wherein a diameter of the outer sidewall of the bottom end of the high pressure tubing is reduced in an area that extends from a top shoulder of the annular seal to the bottom end of the high pressure tubing.

3. The mandrel for a wellhead isolation tool as claimed in claim 1 wherein the top end of the high pressure tubing is adapted to connect to a high pressure tubing connector of the wellhead isolation tool.

4. The mandrel for a wellhead isolation tool as claimed in claim 1 wherein the top end of the high pressure tubing is adapted to connect to a high pressure tubing joint.

5. The mandrel for a wellhead isolation tool as claimed in claim 1 wherein the annular seal is a synthetic rubber seal bonded directly to the outer sidewall of the high pressure tubing.

6. The mandrel for a wellhead isolation tool as claimed in claim 5 wherein the annular seal is a neoprene rubber seal.

7. The mandrel for a wellhead isolation tool as claimed in claim 1 wherein the annular seal is a plastics polymer bonded directly to the outer wall of the mandrel.

8. The mandrel for a wellhead isolation tool as claimed in claim 7 wherein the plastics polymer is a polypropylene.

9. The mandrel for a wellhead isolation tool as claimed in claim 1 wherein the annular seal has a hardness of at least about 70 durometer.

10. The mandrel for a wellhead isolation tool as claimed in claim 2 wherein the mandrel has an outer diameter of about 2.375".

11. The mandrel for a wellhead isolation tool as claimed in claim 10 wherein the area of reduced diameter has an outer diameter of about 2.2".

12. The mandrel for a wellhead isolation tool as claimed in claim 11 wherein the annular seal has an outer diameter of about 2.450".

13. The mandrel for a wellhead isolation tool as claimed in claim 12 wherein the annular seal has a length of about 2.0".

14. The mandrel for a wellhead isolation tool as claimed in claim 12 wherein the length of the area of reduced diameter is about 12".

15. The mandrel for a wellhead isolation tool as claimed in claim 1 wherein the bottom end of the high pressure tubing is bevelled to facilitate entry of the mandrel through the wellhead and into the fluid passage in the tubing hanger.

16. The mandrel for a wellhead isolation tool as claimed in claim 1 wherein a bottom end of the annular seal is bevelled to facilitate entry of the annular seal into the fluid passage in the tubing hanger.

17. The mandrel for a wellhead isolation tool as claimed in claim 1 wherein the bottom end of the mandrel extends at least past a back pressure thread in the fluid passage of the tubing hanger when the annular seal engages the sealing surface in the tubing hanger in a fluid tight seal.

18. The mandrel for a wellhead isolation tool as claimed in claim 17 wherein the bottom end of the mandrel extends into a top end of the tubing string when the annular seal engages the sealing surface in the tubing hanger in a fluid tight seal.

19. The tubing hanger for suspending production tubing in a hydrocarbon well as claimed in claim 18 wherein the sealing surface has a diameter of about 2.40".

20. The tubing hanger for suspending production tubing in a hydrocarbon well as claimed in claim 19 wherein a top of the back pressure thread is spaced down from a top of the fluid passage by at least about 1.50".

21. The tubing hanger for suspending production tubing in a hydrocarbon well as claimed in claim 20 wherein an internal diameter of the cylindrical sealing surface is about 2.40".

22. The tubing hanger for suspending production tubing in a hydrocarbon well as claimed in claim 18 wherein the tubing hanger further includes annular sealing means associated with the outer wall of the body comprising at least one O-ring received in an annular groove in the outer wall of the body.

23. An apparatus for increasing the transfer rate for well stimulation fluids during the production stimulation of a hydrocarbon well, comprising in combination:

a tubing hanger positioned below pressure sensitive valves and flanges in a wellhead of the hydrocarbon well, the tubing hanger supporting a production tubing in the well and having a fluid passage for fluid communication with the production tubing, a top end of the fluid passage including a sealing surface adapted for sealing engagement with a fluid seal;

a mandrel for a wellhead isolation tool, the mandrel having a bottom end for stroking through the wellhead to isolate the pressure sensitive valves and flanges of the wellhead from stimulation fluids to be pumped into the well, the mandrel including an annular seal spaced above the bottom end and bonded to an outer sidewall thereof for sealing engagement with the sealing surface in the top end of the tubing hanger;

whereby when the mandrel is stroked through the wellhead, the bottom end of the mandrel enters the fluid passage in the tubing hanger and is stroked through the fluid passage until the annular seal engages the sealing surface in the fluid passage in the tubing hanger in a fluid tight sealing engagement.

24. An apparatus for increasing the transfer rate for well stimulation fluids during the production stimulation of a hydrocarbon well, comprising in combination:

a tubing hanger supporting a production tubing in the well and having a fluid passage for fluid communication with the production tubing, a top end of the fluid passage including a smooth cylindrical sealing surface adapted for sealing engagement with a fluid seal; and a mandrel for a wellhead isolation tool, the mandrel having a bottom end for stroking through the wellhead to isolate pressure sensitive valves and flanges of the wellhead from stimulation fluids to be pumped into the well, an outer surface of the mandrel spaced above the bottom end defining an annular seal for sealing engagement with the smooth cylindrical sealing surface of the tubing hanger.

25. An apparatus for increasing the transfer rate of production stimulation fluids through a wellhead of a hydrocarbon well, comprising in combination:

a tubing hanger which provides a sealing surface against which a mandrel may sit in a fluid tight seal; and the mandrel comprising a hollow high pressure tubing having a top end, a bottom end, an outer sidewall and a fluid passage that extends between the top end and the bottom end, and an annular seal formed above the bottom end of the outer sidewall for sealing engagement with the sealing surface of the tubing hanger.

* * * * *